US005353885A

United States Patent [19]

Hooper et al.

[11] Patent Number: 5,353,885

[45] Date of Patent: Oct. 11, 1994

[54] ROCK BIT

[75] Inventors: Michael E. Hooper, Spring, Tex.; David P. Crockett, Moorpark, Calif.

[73] Assignee: Smith International, Inc., Houston, Tex.

[21] Appl. No.: 89,356

[22] Filed: Jul. 9, 1993

Related U.S. Application Data

[63] Continuation of Ser. No. 906,999, Jul. 1, 1992, abandoned, which is a continuation of Ser. No. 693,900, May 1, 1991, abandoned.

[51] Int. Cl.[5] ..... E21B 10/16

[52] U.S. Cl. ..... 175/378; 175/374; 175/434

[58] Field of Search ..... 175/374, 378, 376, 434, 175/431

[56] References Cited

U.S. PATENT DOCUMENTS

| | | | |
|---|---|---|---|
| 2,774,570 | 12/1956 | Cunningham . | |
| 2,774,571 | 12/1956 | Morlan . | |
| 2,804,282 | 8/1957 | Spengler, Jr. | 175/378 |
| 2,990,025 | 6/1961 | Talbert et al. | 175/410 X |
| 3,727,705 | 4/1973 | Newman | 175/374 |
| 3,925,815 | 4/1976 | Dysart | 175/374 |
| 4,106,578 | 8/1978 | Beyer | 175/410 X |
| 4,148,368 | 4/1979 | Evans | 175/329 |
| 4,339,009 | 7/1982 | Bushy | 175/374 |
| 4,343,372 | 6/1980 | Kinzer | 175/374 |
| 4,811,801 | 3/1989 | Salesky et al. | 175/329 |
| 4,940,099 | 7/1990 | Deane et al. | 175/378 X |

FOREIGN PATENT DOCUMENTS

| | | | |
|---|---|---|---|
| 295032 | 12/1988 | European Pat. Off. | 175/410 |
| 1452916 | 1/1989 | U.S.S.R. | 175/329 |

*Primary Examiner*—Hoang C. Dang
*Attorney, Agent, or Firm*—Robert M. Vargo

[57] ABSTRACT

A rock bit is disclosed having a plurality of rolling cone cutters each having a gage row of inserts oriented to face the borehole bottom for crushing the same, and a second row of heel gage inserts which are oriented to face the borehole sidewall for scraping the same, heel inserts are nestled within the profile of the gage inserts in order to alleviate most of the scraping action normally encountered by gage inserts.

5 Claims, 4 Drawing Sheets

ROCK BIT

CROSS-REFERENCE TO RELATED APPLICATION

This is a continuation of U.S. application Ser. No. 906,999 filed Jul. 1, 1992, which is a continuation of U.S. application Ser. No. 693,900 filed May 1, 1991, now abandoned.

BACKGROUND OF THE INVENTION

I. FIELD OF THE INVENTION

The present invention relates generally to earth boring drill bits having rotatable rolling cutters mounted thereon, and more specifically to the positioning of wear resistant inserts located on the gage rows of the cutters.

II. DESCRIPTION OF THE PRIOR ART

Earth boring bits for drilling oil and gas wells typically have three rotatable cutters that roll over the bottom of a borehole as the bit rotates. Each cutter is generally conical and has a frustoconical heel surface that passes near the borehole sidewall as the cutter rotates. One type of bit, known as a tungsten carbide insert bit or TCI bit, has wear resistant inserts secured in holes formed in the cutters. Such inserts are usually made of tungsten carbide.

For each cutter, the inserts are arranged in circumferential rows on the conical surface thereof at various distances from the heel surface. The row nearest, but not on the heel surface is known as the gage row.

In some types of bits, such as shown in U.S. Pat. No. 3,727,705, certain cutters have gage row structure that includes staggered rows located thereon. The staggered rows comprise two rows of inserts alternately spaced so that the grip portion of the inserts do not interfere. See also U.S. Pat. No. 4,343,372.

In other prior art bits (see FIG. 4), the inserts on the gage row are oriented in such a manner to cause the gage cutting elements to cut both the borehole bottom and sidewall. This combined cutting action compromises the insert because the cutting action operating on the borehole bottom is usually a crushing and gouging action while the cutting action operating on the sidewall is a scraping action. Ideally, a crushing action calls for a tough insert while a scraping action calls for a hard insert. One grade of tungsten carbide can not be hard and tough at the same time and can not ideally perform both functions. As a result, compromises are required and the gage cutters can not be as tough as the inner rows of cutters because they must be harder to accommodate the scraping action.

Other bits have a row of inserts mounted on the heel surface to contact the sidewall. However, this is usually accomplished after the gage row of inserts has formed the borehole sidewall and bottom.

U.S. Pat. Nos. 2,774,570 and 2,774,571 show such arrangements. In each instance, the gage row of inserts is still physically compromised because the lower portion of each insert must still engage the borehole bottom while the outside portion scrapes the sidewall. The heel row functions to maintain the gage after it is formed by the gage cutters. This is because the heel row cutters are separated a distance from the gage row cutters, and do not extend to the hole bottom.

SUMMARY OF THE INVENTION

The present invention obviates the above-mentioned shortcomings by providing a rolling cone drill bit in which the heel row of inserts are nestled within the profile of the gage row of inserts with the heel inserts oriented to face the sidewall and the gage inserts oriented toward the hole bottom. Because of this orientation, and because of the close proximity of the two rows, there is much less of the secondary cutting that the respective rows must make i.e. the heel row of inserts accomplishes the scraping action on the sidewall with very little contact with the hole bottom and the gage row accomplishes the crushing and gouging action on the hole bottom with very little contact with the hole sidewall.

As a result, the bit made in accordance with the present invention can have heel row inserts that are harder and gage row inserts that are tougher. In fact, the heel row of inserts can be made with a diamond coating on their outer surface, while the gage row of inserts can be made of the same tough grade of tungsten carbide as the interior rows of the cones.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
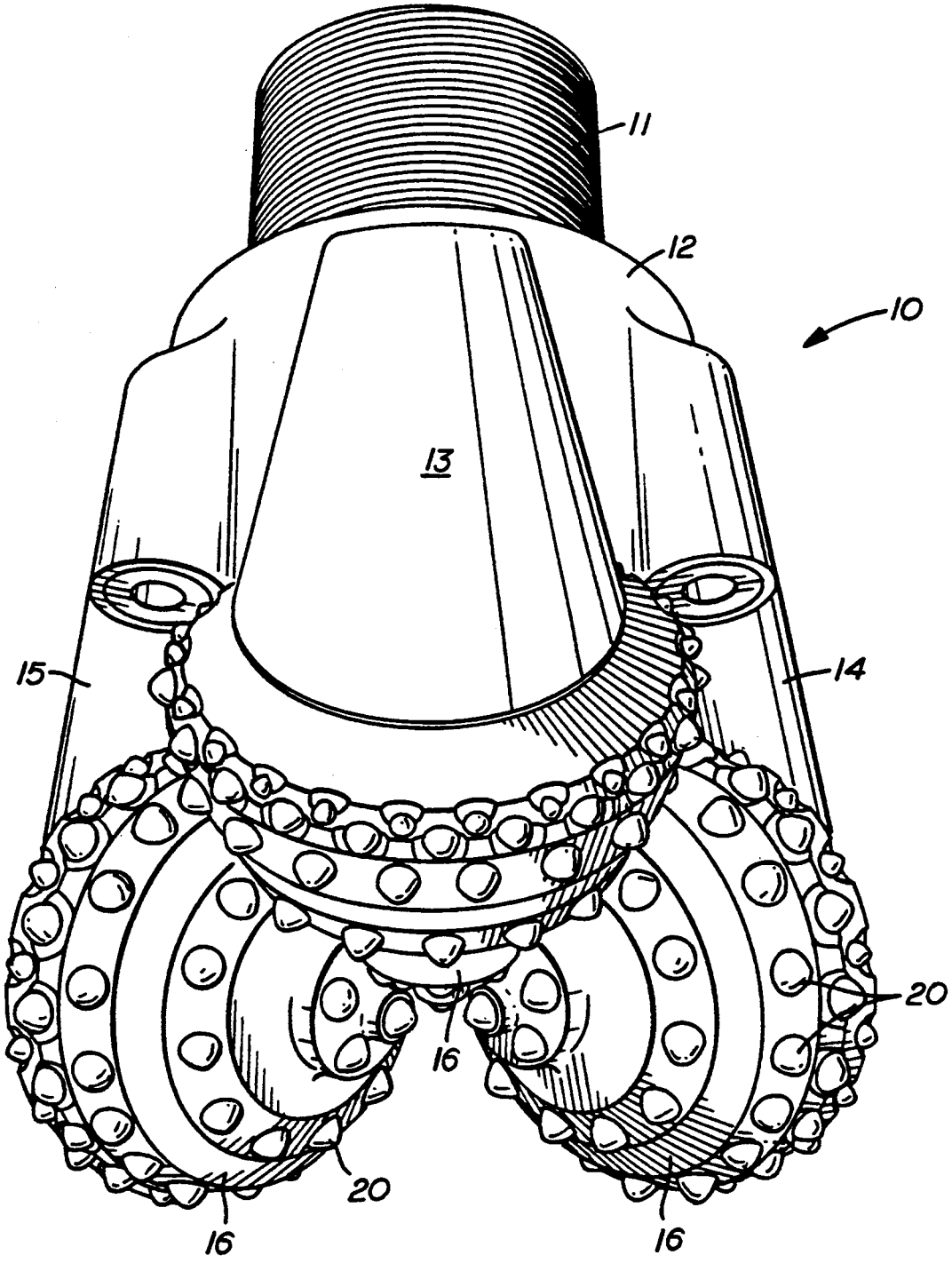
FIG. 1 is a perspective view of a three cone rock bit utilizing the gage row cutters made in accordance with the present invention.

FIG. 1 illustrates a drill bit, generally indicated by arrow 10, having a threaded pin section 11 for securing to the bottom end of a drill string. The drill bit 10 further includes a main body 12 having a plurality of legs 13, 14 and 15 extending downwardly therefrom. Each leg includes a beating pin (not shown) extending toward the center of the bit. Three cone shaped cutters 16 are rotatably mounted on the bearing pins and are adapted to roll along the bottom of a borehole as the bit is rotated. The cutters 16 tend to roll along the hole bottom much like a wheel except that because the bearing pins are offset from the axis of the bit, and because of the geometry of the cones, a true roll of the cones is not possible. Therefore, in addition to the rolling motion, a small sliding motion is imparted thereto which would be analogous to the movement of an automobile tire that is out of alignment.

Each cutter 16 has a plurality of wear resistant inserts 20 interferingly secured by the insert grip 90 in mating holes drilled in the support surface thereof. Preferably the inserts 20 are constructed from sintered tungsten carbide.

The inserts 20 are located in rows that extend circumferentially around the generally conical surface of each cutter. Certain of the rows are arranged to intermesh with other rows of the other cutters.

Figure 2:
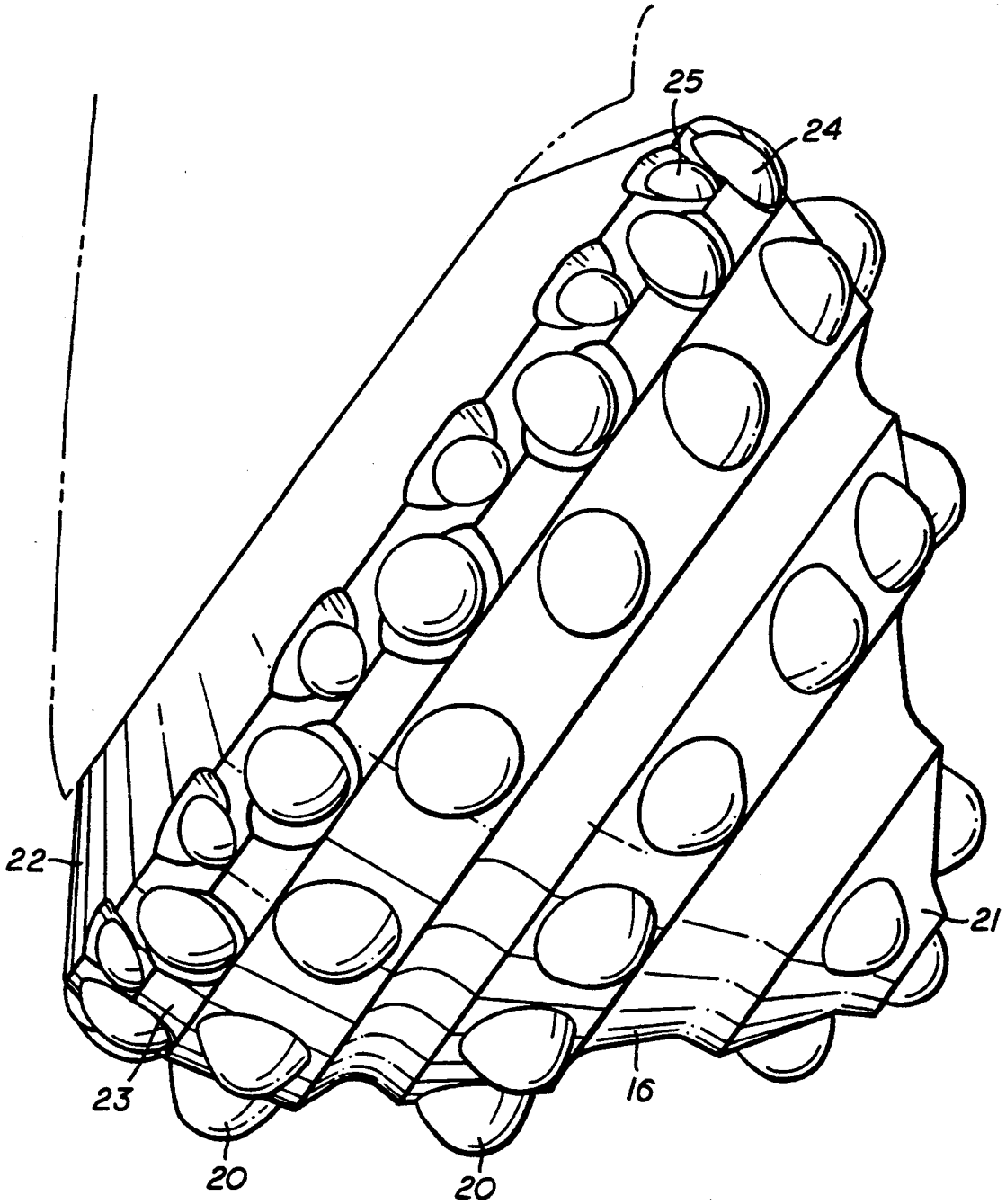
FIG. 2 is an enlarged perspective view of one of the cones shown in FIG. 1.

Referring now to FIG. 2, as mentioned previously each cutter 16 is generally conically shaped with a nose area 21 at the apex of the cone and a heel surface 22 at the base of the cone. The heel surface 22 is frustoconical and is adapted to pass near the wall of the borehole as the cutters rotate about the borehole bottom. The row of inserts 20 closest to the heel surface 22 is called the gage row 23 having a plurality of gage inserts 24. Also nestled within the gage row inserts are a plurality of heel inserts 25.

Figure 3:
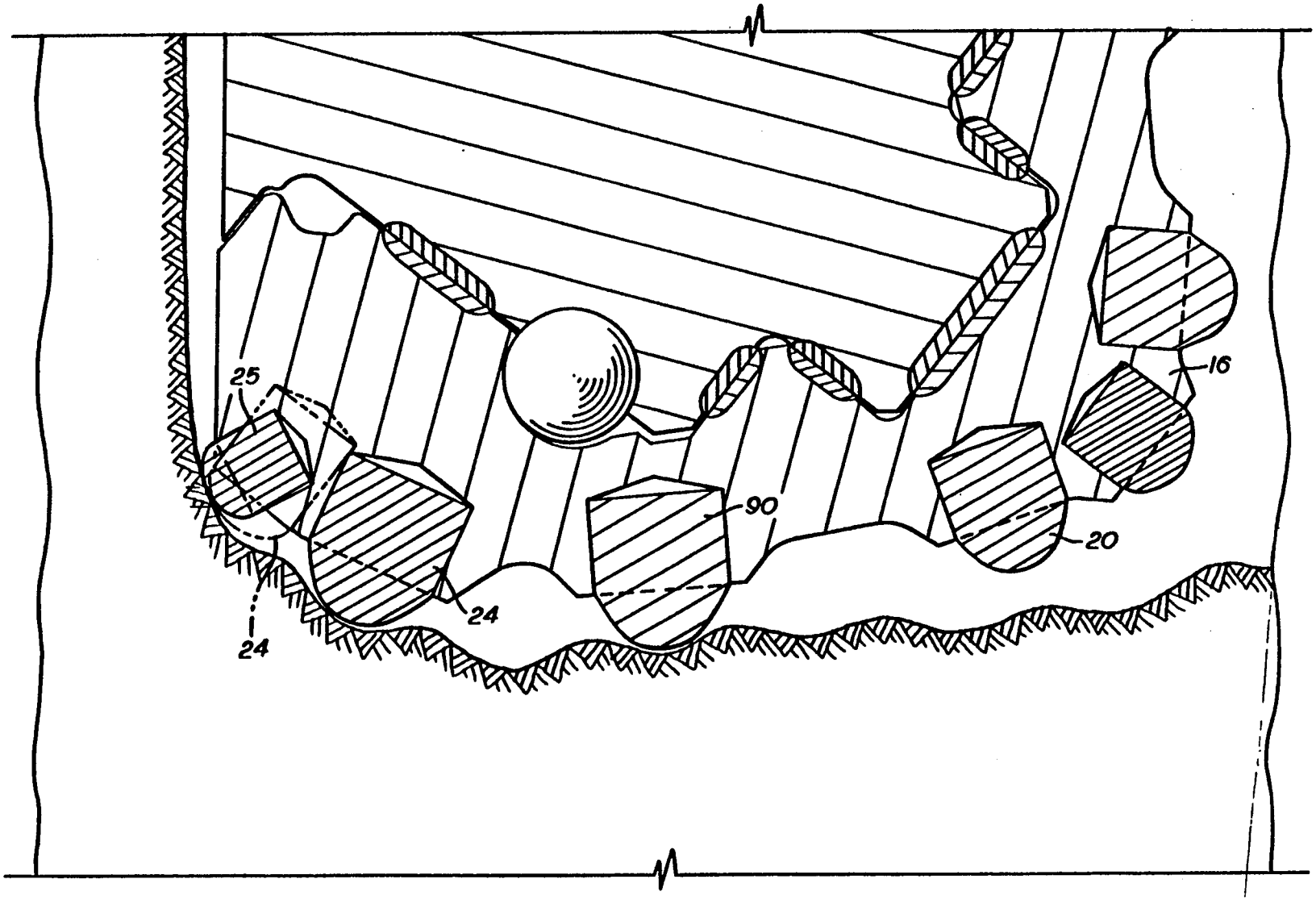
FIG. 3 is a sectional view of the cone through the centerline of the cone located in a borehole thereby defining a specific profile.

As shown in FIGS. 2 and 3, the gage inserts 24 are oriented to face the borehole bottom while the heel inserts 25 are oriented to face the sidewall of the borehole. It should also be noted that the projected crown areas of the gage inserts slightly overlap with the projected crown areas of the heel inserts.

During drilling operations, a tremendous amount of weight from the drill is applied to the bit 10 as it is rotated. In FIG. 2, as the inserts 20 of the first three rows, beginning with the nose row, are rotated on the cutter, they eventually come in contact with the formation. The imprint made on the formation is created by the insert contacting the formation with its trailing side, rolling on the formation about its apex, and then exiting with the last contact being made by its leading side. During this rolling movement, the offset of the cone axis causes each insert 20 to slide a small amount which causes the imprint to become somewhat elongated. This combined rolling and sliding motion along with extreme loads involved causes the formation contacted by the insert to be crushed little chips being broken off thereby.

Because of the high loads involved with this crushing action, the inserts 20 must be made of an extremely tough grade of tungsten carbide.

Figure 4:
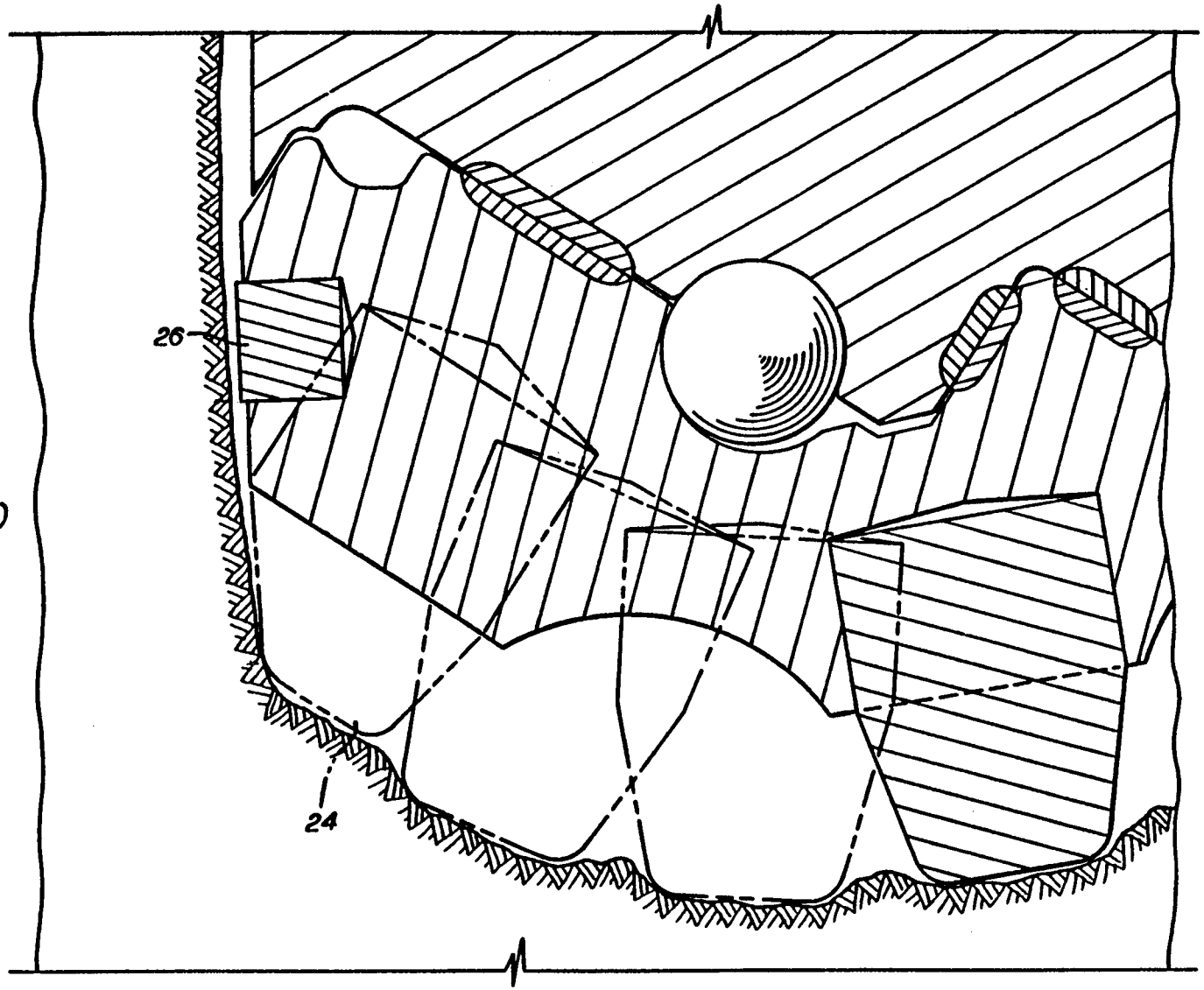
FIG. 4 (PRIOR ART)
FIG. 4 is a sectional view of a prior art cone showing the location of a conventional heel row insert.

The gage row of inserts 24 also contact the hole bottom in a similar manner. However, prior to the present invention, these inserts 24 also performed a scraping action along the borehole side wall before they make their imprint on the borehole bottom (see FIG. 4). As mentioned previously, this necessitated making the gage row inserts harder to accommodate the scraping function. Unfortunately, when one makes a tungsten carbide insert harder, it necessarily becomes less tough.

Because of these compromises, the gage rows of inserts in prior art bits suffered from breakage problems. As a result, heel inserts had to be placed on the heel surfaces of the cones to ensure the heel surface integrity after the gage inserts broke or wore down. Since such inserts were separated a distance from the gage inserts, they did not come into play and did not contact the sidewall until after the gage inserts broke or wore to a certain point, the problems concerning gage insert breakage were not obviated.

The present invention does obviate such a problem by having the heel row inserts 25 being nestled within the profile of the gage inserts with the crowns thereof slightly overlapping in order for the heel inserts 25 to engage the borehole sidewall at points much lower in the borehole and much sooner in the cutting cycle than previous heel inserts. By scraping away the borehole sidewall in those lower areas before the gage inserts have the opportunity to engage them, the gage inserts 24 are spared from having to do a large amount of scraping. As a result, there would be a much smaller amount of gage insert scraping compared to the prior art, and this amount would not require the gage inserts to make any compromises from a toughness standpoint. Since the vast majority of the cutting action of the gage inserts would be the crushing and gouging action occurring on the borehole bottom, the gage row inserts 24 can now be made of the same tough grade of tungsten carbide as the inner rows of inserts.

Moreover, since the heel row inserts 25 are restricted to mostly scraping, they can be made of a very hard tungsten carbide or they could also be coated with super hard abrasives such as polycrystalline diamond.

Although the inserts 24 are shown as hemispherical, they could also be constructed of different conventional shapes such as chisels. In addition, the heel row inserts 25 can have their abrasive surfaces be slightly hemispherical, flat, or some other configuration and still come within the invention.

It will of course be realized that various other modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A rock bit for drilling a borehole having a plurality of cutters each mounted thereon to rotate about an axis, each cutter having a generally frusto-conical support surface for rolling contact with the bottom of the borehole, each cutter further having a heel surface at the base thereof for rolling contact with the sidewall of the borehole, a plurality of wear resistant inserts positioned on said support surface and being arranged in circumferential rows, each insert being generally cylindrical and having a central axis, the improvement comprising:

one of the rows of inserts being positioned next to the heel surface defining a row of gage inserts, with each gage insert oriented to have its axis extend outwardly and having a crown area adapted to engage the borehole bottom, each gage insert further defining a cutter surface profile taken through a section of the cone through the centerline; and a plurality of heel inserts located near said gage inserts at an acute angel with respect to the gage inserts in a direction away from the apex of the cone, each heel insert having a crown area adapted to engage the sidewall of the borehole and further defining a cutting surface profile taken through a section of the cone through the centerline, said heel profile taken through a section of the cone through the centerline, said heel profile, when rotated around the cone to be overlapped on the same plane as a gage insert profile having its crown area slightly overlapping on one side with the crown area of the gage insert profile, said heel inserts are the only inserts or cutting elements on the heel surface of the cutter.

2. The invention of claim 1 wherein the heel inserts are alternated between the gage inserts.

3. The invention of claim 1 wherein said gage inserts are made of tungsten carbide.

4. The invention of claim 3 wherein the gage inserts are made of the same tough grade as the other rows of inserts.

5. The invention of claim 1 wherein the heel inserts are coated with an outer layer of polycrystalline diamond.

* * * * *